US005600426A

United States Patent [19]

Gramlich et al.

[11] Patent Number: 5,600,426

[45] Date of Patent: Feb. 4, 1997

[54] SELF-ALIGNING, LOW JAM RATE IDLER ASSEMBLY

[75] Inventors: John D. Gramlich, Webster; Margaret C. Plain, Rochester; Robert F. Rubscha, Fairport; Cesidio J. Dicesare; Theodore J. Kellogg, both of Rochester, all of N.Y.

[73] Assignee: Xerox Corporation, Stamford, Conn.

[21] Appl. No.: 220,383

[22] Filed: Mar. 30, 1994

[51] Int. Cl.[6] ..... G03G 21/00

[52] U.S. Cl. ..... 399/381; 271/274

[58] Field of Search ..... 355/317, 205, 355/308, 207, 309, 319; 271/274

[56] References Cited

U.S. PATENT DOCUMENTS

| | | | |
|---|---|---|---|
| 3,743,406 | 7/1973 | Komari | 355/233 |
| 3,942,785 | 3/1976 | Stange | 271/65 |
| 3,948,511 | 4/1976 | Smith et al. | 271/274 |
| 4,452,524 | 6/1984 | Parisi | 355/315 X |
| 4,780,746 | 10/1988 | Naramore et al. | 355/309 |
| 4,850,584 | 7/1989 | Watashi | 271/274 |
| 4,997,179 | 3/1991 | Mizutani et al. | 271/306 |
| 5,199,702 | 4/1993 | Davis et al. | 271/274 |
| 5,269,509 | 12/1993 | Cromar et al. | 271/272 |
| 5,449,160 | 9/1995 | Hou et al. | 355/319 X |

FOREIGN PATENT DOCUMENTS

| | | | |
|---|---|---|---|
| 58-144034 | 8/1983 | Japan | 271/274 |
| 60-244736 | 12/1985 | Japan | 271/274 |
| 63-258340 | 10/1988 | Japan | 271/274 |
| 3-293242 | 12/1991 | Japan | 271/274 |
| 6-144633 | 5/1994 | Japan | 271/274 |

*Primary Examiner*—Shuk Yin Lee
*Attorney, Agent, or Firm*—Kevin R. Kepner

[57] ABSTRACT

An idler system that is both self-centering and self-aligning with a drive roll. The idler assembly consists of a pair of rolls connected by a shaft, the shaft being supported in a housing. The housing is retained by a resilient spring member which member allows the axis of rotation of the idler rolls to pivot in more than one plane simultaneously. This pivoting causes the axis of rotation of the idler assembly to align parallel with the drive roll axis. The single spring also provides an even loading of the normal force across the width of the drive nip. As a result of the alignment and even loading, skewing of a sheet is prevented as it is driven through the nip formed by the drive roll and the idler roll. The resilient spring mounting also allows for easy replaceability of the idler assembly and the housing is easily locatable between tabs formed in the frame of the machine for mounting the idler assembly therein. The housing provides a guide from the mounting frame into the nip and from the nip into the downstream paper path for increased capacity to handle curled and/or damaged cut sheet media.

12 Claims, 5 Drawing Sheets

SELF-ALIGNING, LOW JAM RATE IDLER ASSEMBLY

This invention relates generally to an idler roll assembly, and more particularly concerns a self-aligning, low jam rate idler assembly for use in transporting cut sheets in an electrophotographic printing machine.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet. After each transfer process, the toner remaining on the photoconductor is cleaned by a cleaning device.

In printing machines such as those described above, a paper path using drive rolls and idler rolls directs the copy receiving substrates throughout the machine. Similar drive and idler rolls are used to handle original documents in automatic document handlers for imaging original documents. Two common configurations of idler roll assemblies are often used. The first has one, two or more idler rolls with internally mounted bearings rotating independently on a stationary shaft. The shaft can be either center or end loaded. In the second configuration the rolls are press fit or molded to a rotating shaft, the shaft is loaded at both ends requiring two bearing surfaces.

These configurations have two inherent faults, In the first configuration, independent roll rotation allows the individual idler to follow the individual drive roll speeds, if the drive roll speeds are not exactly the same, due to slight differences in roll radii and/or uneven loading, a piece of paper driven at two different speeds will rotate, skewing the sheet as it travels through the nip.

The second fault is the dual loading points. Any variation in spring force will apply uneven loading, compressing the drive roll elastomer to different radii with respect to the second roll on the same shaft and the end result again is different drive roll velocities skewing the sheet as it travels through the nip.

Accordingly it is desirous to have a low cost idler roll that is self centering and applies an equal load to the sheets to minimize sheet skewing. It is further advantageous to have an idler that can assist in offsetting drive roll variations which leads to more precise paper control and less skew. Ease of installation and the ability to handle curled and/or damaged sheets and to maintain a low noise level while having high reliability and low cost are other advantageous features.

The following disclosures may be relevant to various aspects of the present invention:

U.S. Pat. No. 5,269,509
Inventor: Cromar, et al.
Issue Date: Dec. 14, 1993

U.S. Pat. No. 4,997,179
Inventor: Mizutani et al.
Issue Date: Mar. 5, 1991

U.S. Pat. No. 4,452,524
Inventor: Parisi
Issue Date: Jun. 5, 1984

U.S. Pat. No. 3,948,511
Inventor: Smith et al.
Issue Date: Apr. 6, 1976

U.S. Pat. No. 3,942,785
Inventor: Stange
Issue Date: Mar. 9, 1976

U.S. Pat. No. 3,743,406
Inventor: Komari et al.
Issue Date: Jul. 3, 1973

The relevant portions of the foregoing disclosures may be briefly summarized as follows:

U.S. Pat. No. 5,269,509 describes a cut sheet registration guide having at least two idler rolls biased into contact with a feed roll, the idler rolls being pivotally mounted on a bar which is itself pivotally mounted with respect to the axis of the feed roll.

U.S. Pat. No. 4,997,179 discloses a sheet feeder having a drive roller in contact with an idler roll retained by a leaf spring to provide a normal force to a sheet.

U.S. Pat. No. 4,452,524 describes a printing machine having a first frame portion having a fixed drive roll and a second frame portion having an idler roll position opposite the drive roll. The second frame is biased toward the first frame and the second frame is self-referenced against the first frame.

U.S. Pat. No. 3,948,511 discloses a sheet feeding device having a plurality of feed rollers mounted on a shaft with a second shaft also having rollers mounted thereon biased into contact with the first shaft.

U.S. Pat. No. 3,942,785 describes a sheet inverter having an idler roll biased toward a drive roll.

U.S. Pat. No. 3,743,406 describes a document transport table in which three springs are used to lock the upper and lower roll groups together.

In accordance with one aspect of the present invention, there is provided an apparatus for applying a normal force to a sheet being advanced by a drive member. The apparatus comprises an idler member having a longitudinal axis of rotation, said idler member being in contact with the drive member to form a nip therebetween through which the sheet advances and a retaining member to secure said idler in contact with the drive member, said retaining member being adapted to permit said idler member to simultaneously pivot in a plurality of planes about a preselected point of the longitudinal axis of rotation to maintain alignment with the drive member.

Pursuant to another aspect of the present invention, there is provided an electrophotographic printing machine having a paper path in which sheets are advanced by a drive member while having a normal force applied thereto, the normal force being applied by a self-aligning apparatus. The apparatus comprises an idler member having a longitudinal axis of rotation, said idler member being in contact with the drive member to form the nip therebetween through which the sheet advances and a retaining member to maintain said idler in contact with the drive member, said retaining member being adapted to permit said idler member to simultaneously pivot in a plurality of planes about a preselected point of the longitudinal axis of rotation to maintain alignment with the drive member.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 5:
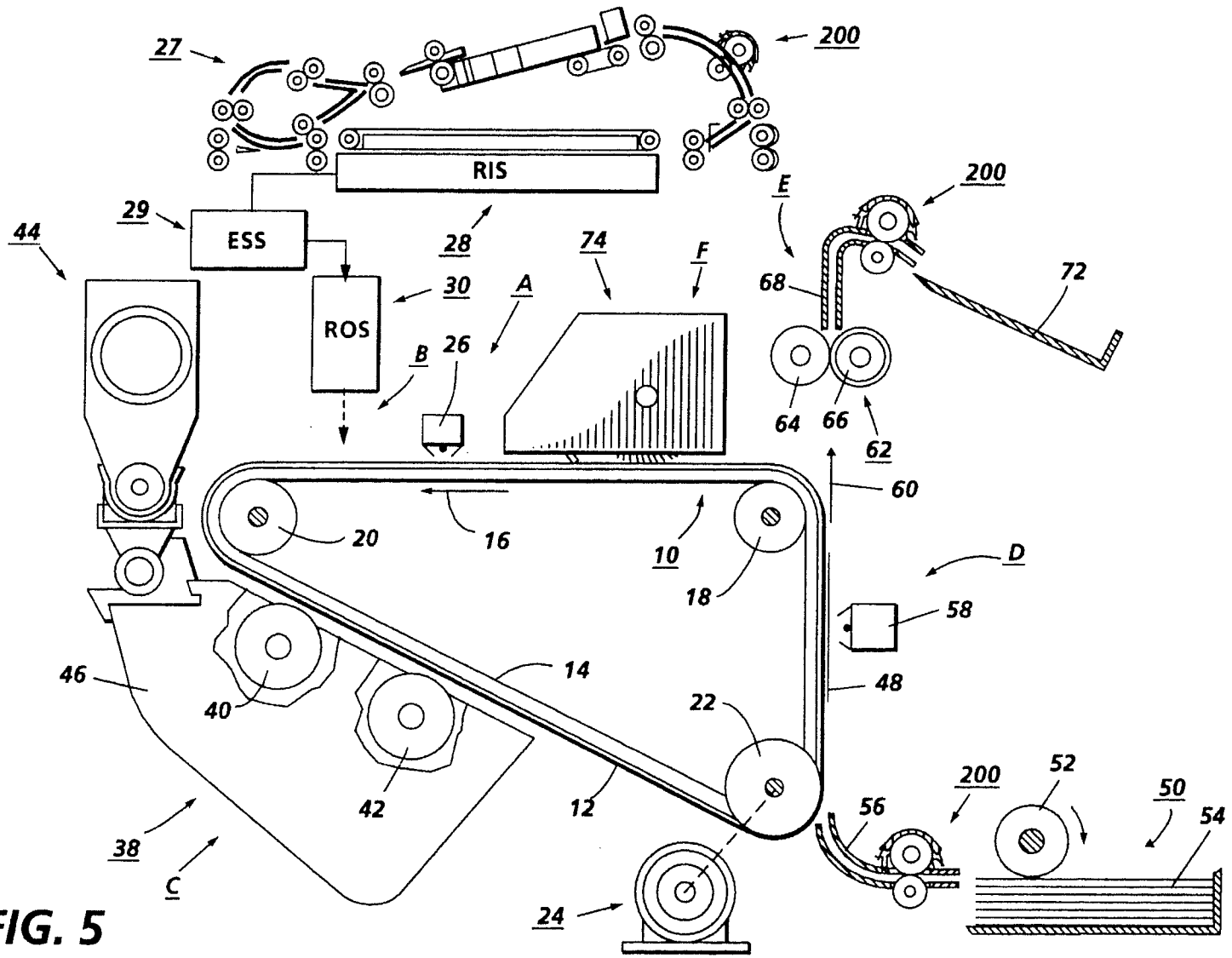
FIG. 5 is a schematic elevational view of a typical electrophotographic printing machine utilizing the FIG. 1 idler therein.

For a general understanding of the features of the present invention, reference is made to the drawings. In the drawings, like reference numerals have been used throughout to identify identical elements. FIG. 5 schematically depicts an electrophotographic printing machine incorporating the features of the present invention therein. It will become evident from the following discussion that the self-aligning idler assembly of the present invention may be employed in a wide variety of devices and is not specifically limited in its application to the particular embodiment depicted herein.

Referring to FIG. 5 of the drawings, an original document is positioned in a document handler 27 on a raster input scanner (RIS) indicated generally by reference numeral 28. The RIS contains document illumination lamps, optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) described below.

FIG. 5 schematically illustrates an electrophotographic printing machine which generally employs a belt 10 having a photoconductive surface 12 deposited on a conductive ground layer 14. Preferably, photoconductive surface 12 is made from a photoresponsive material, for example, one comprising a charge generation layer and a transport layer. Conductive layer 14 is made preferably from a thin metal layer or metallized polymer film which is electrically grounded. Belt 10 moves in the direction of arrow 16 to advance successive portions of photoconductive surface 12 sequentially through the various processing stations disposed about the path of movement thereof. Belt 10 is entrained about stripping roller 18, tensioning roller 20 and drive roller 22. Drive roller 22 is mounted rotatably in engagement with belt 10. Motor 24 rotates roller 22 to advance belt 10 in the direction of arrow 16. Roller 22 is coupled to motor 24 by suitable means, such as a drive belt. Belt 10 is maintained in tension by a pair of springs (not shown) resiliently urging tensioning roller 20 against belt 10 with the desired spring force. Stripping roller 18 and tensioning roller 20 are mounted to rotate freely.

Initially, a portion of belt 10 passes through charging station A. At charging station A, a corona generating device, indicated generally by the reference numeral 26 charges the photoconductive surface, 12, to a relatively high, substantially uniform potential. After photoconductive surface 12 of belt 10 is charged, the charged portion thereof is advanced through exposure station B.

At an exposure station, B, a controller or electronic subsystem (ESS), indicated generally by reference numeral 29, receives the image signals representing the desired output image and processes these signals to convert them to a continuous tone or greyscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. Preferably, a nine facet polygon is used. The ROS illuminates the charged portion of photoconductive belt 20 at a resolution of about 300 or more pixels per inch. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 20 on a raster-by-raster basis.

After the electrostatic latent image has been recorded on photoconductive surface 12, belt 10 advances the latent image to a development station, C, where toner, in the form of liquid or dry particles, is electrostatically attracted to the latent image using commonly known techniques. Preferably, at development station C, a magnetic brush development system, indicated by reference numeral 38, advances developer material into contact with the latent image. Magnetic brush development system 38 includes two magnetic brush developer rollers 40 and 42. Rollers 40 and 42 advance developer material into contact with the latent image. These developer rollers form a brush of carrier granules and toner particles extending outwardly therefrom. The latent image attracts toner particles from the carrier granules forming a toner powder image thereon. As successive electrostatic latent images are developed, toner particles are depleted from the developer material. A toner particle dispenser, indicated generally by the reference numeral 44, dispenses toner particles into developer housing 46 of developer unit 38.

With continued reference to FIG. 5, after the electrostatic latent image is developed, the toner powder image present on belt 10 advances to transfer station D. A print sheet 48 is advanced to the transfer station, D, by a sheet feeding apparatus, 50. Preferably, sheet feeding apparatus 50 includes a feed roll 52 contacting the uppermost sheet of stack 54. Feed roll 52 rotates to advance the uppermost sheet from stack 54 through drive roll idler assembly 200 forwarding the sheet into chute 56. Chute 56 directs the advancing sheet of support material into contact with photoconductive surface 12 of belt 10 in a timed sequence so that the toner powder image formed thereon contacts the advancing sheet at transfer station D. Transfer station D includes a corona generating device 58 which sprays ions onto the back side of sheet 48. This attracts the toner powder image from photoconductive surface 12 to sheet 48. After transfer, sheet 48 continues to move in the direction of arrow 60 onto a conveyor (not shown) which advances sheet 48 to fusing station E.

The fusing station, E, includes a fuser assembly, indicated generally by the reference numeral 62, which permanently affixes the transferred powder image to sheet 48. Fuser assembly 60 includes a heated fuser roller 64 and a back-up roller 66. Sheet 48 passes between fuser roller 64 and back-up roller 66 with the toner powder image contacting fuser roller 64. In this manner, the toner powder image is permanently affixed to sheet 48. After fusing, sheet 48 advances through chute 68 again through one or more drive roll idler roll assembly 200 to catch tray 72 for subsequent removal from the printing machine by the operator.

After the print sheet is separated from photoconductive surface 12 of belt 10, the residual toner/developer and paper fiber particles adhering to photoconductive surface 12 are removed therefrom at cleaning station F. Cleaning station F includes a rotatably mounted fibrous brush in contact with photoconductive surface 12 to disturb and remove paper fibers and a cleaning blade to remove the nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the features of the present invention therein.

Figure 1:
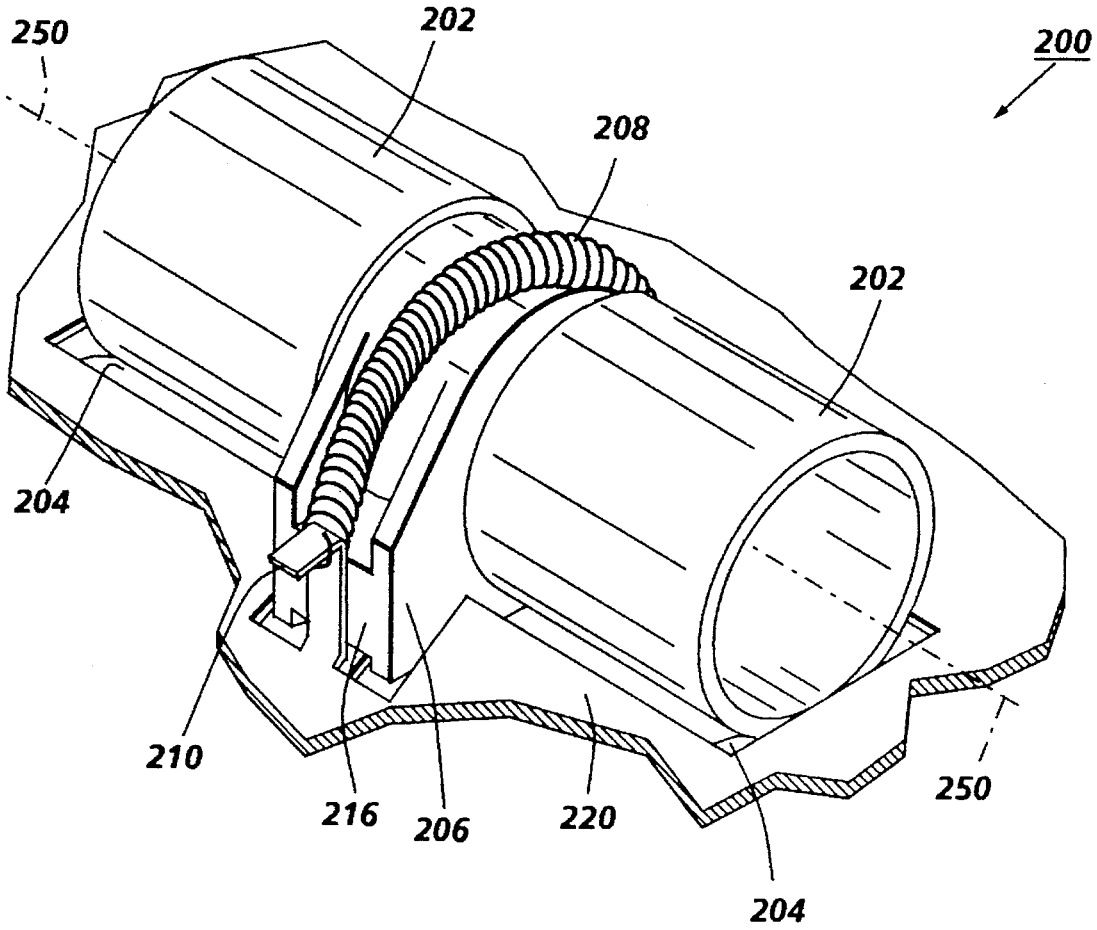
FIG. 1 is a perspective view of the idler and idler mounting arrangement of the present invention.

Turning now to FIG. 1, there is illustrated a perspective view of the idler mounting system of the present invention. The idler assembly, generally referred to by reference numeral 200 is shown mounted in circumferential contact with drive rolls 204. The idler assembly 200 is made up of a pair of rolls 202 which are centrally supported by a housing 206 between the rolls 202. A resilient mounting member, illustrated in the form of a spring 208, is used to secure the central housing portion 206 of the idler assembly 200 to the machine frame 220.

Figure 2:
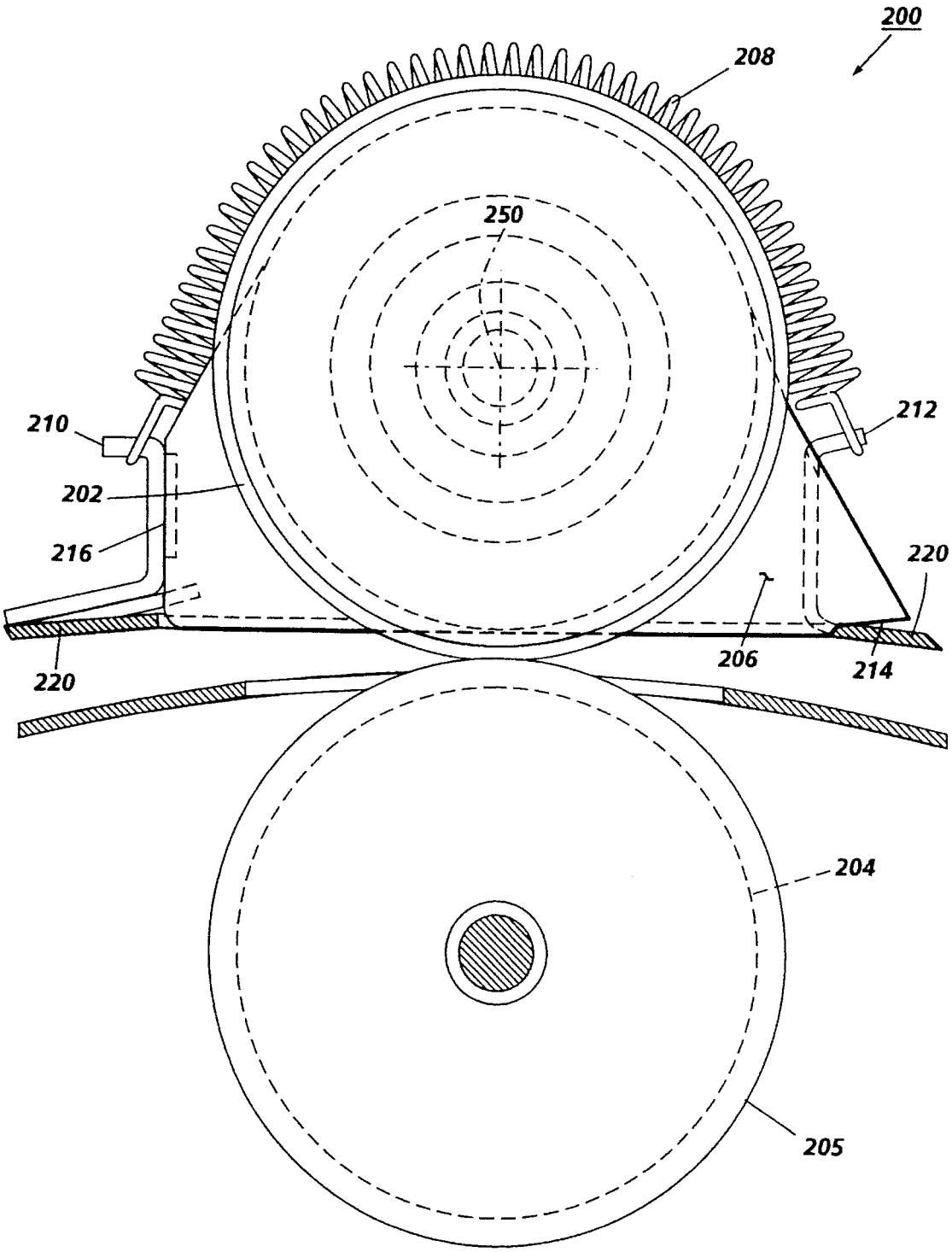
FIG. 2 is a side elevational view of the idler mount system illustrating the cooperation between the idler and drive roll of the present invention.
Figure 3:
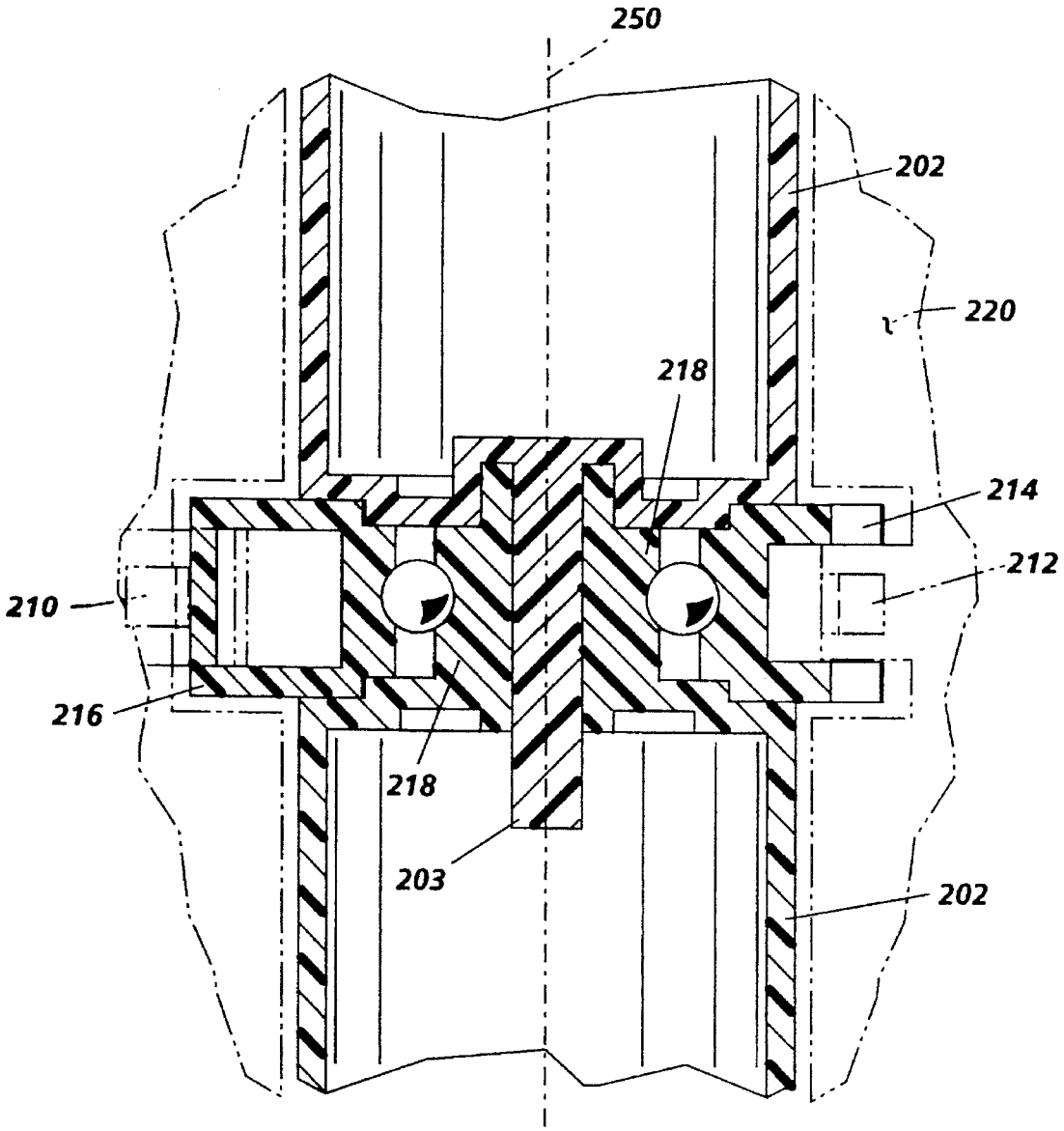
FIG. 3 is a partial sectional plan view of the idler mount system.

FIG. 2 is a side elevational view of the idler assembly 200 shown in contact with the drive roll 204. The central housing 206 which contains the bearing 218 (FIG. 3) for the idler shaft 203 (FIG. 3) has a baffle 214 built into it so the leading edge of the sheet is guided into the nip formed between the idler roll 202 and the drive roll 204. The drive roll 204 is coated with an elastomer coating 205 such as silicone rubber which provides good frictional contact with the sheets being fed and is impervious to commonly used silicone release agents.

Figure 4:
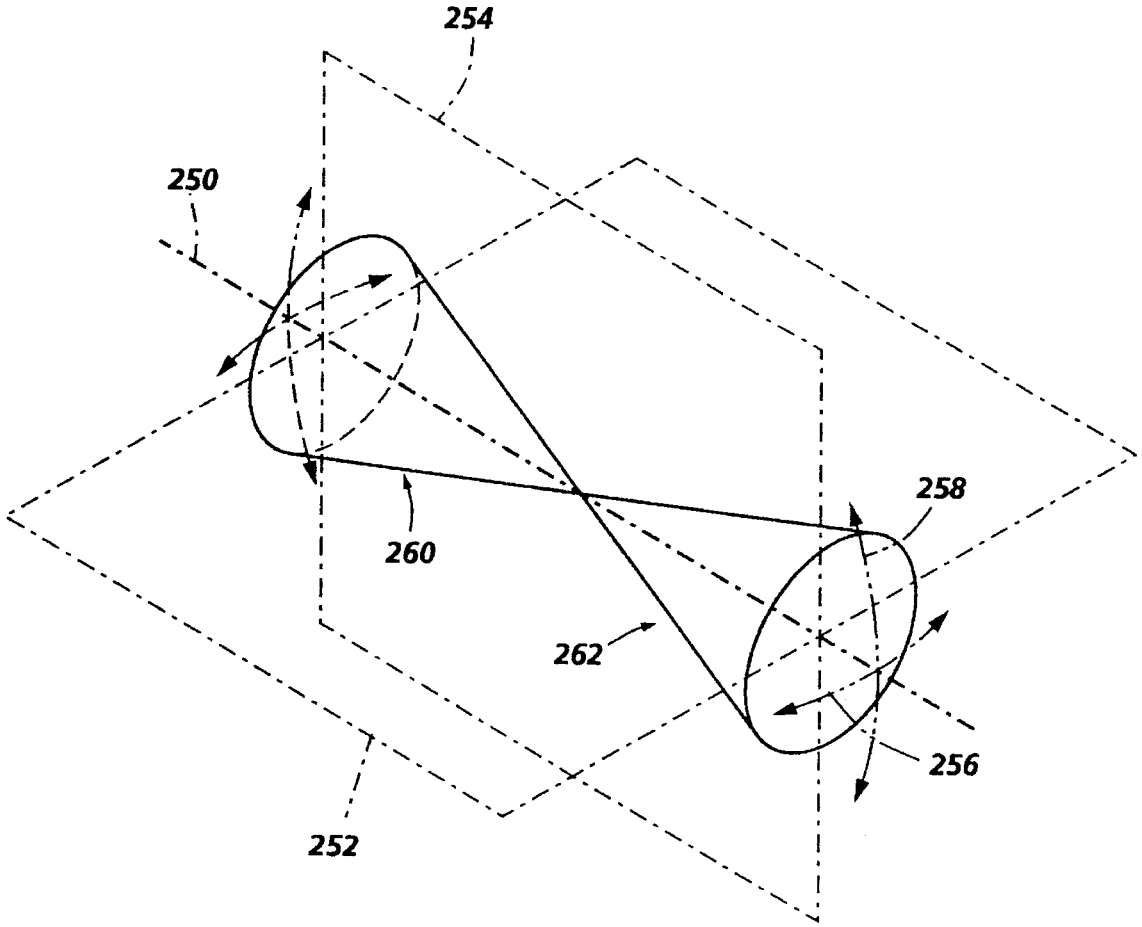
FIG. 4 is a graphical illustration of the range of motion of the axis of rotation of the idler system of the present invention.

The housing 206 is prevented from rotating with the idler rolls 202 by way of an abutment 216 which fits against a tab 210 on the machine and also by the baffles 214 fitting into the machine frame. The retaining spring 208 is connected to tabs 210 and 212 to retain the idler assembly in position. The opening in the frame 220 is slightly larger than the idler assembly to allow the assembly 200 to move to obtain alignment with the drive rolls 204. As a result of the center spring retaining member 208, the idler assembly 200 is free to move in more than one plane simultaneously so as to aligned and remain aligned with the drive rolls 204. The spring 208 and the housing 206 create a pivot point about which the idler assembly 200 is free to pivot. The pivot point is located at approximately the center point on its axis of rotation 250. This allows the assembly to pivot in both a plane 252 (FIG. 4) essentially parallel to the plane of a sheet passing through the nip as well as in a plane 254 (FIG. 4) essentially perpendicular to the first plane 252. The resultant of each of these pivoting motions is shown in FIG. 4 and described below. It would of course be possible to locate the pivot point at other than the approximate center of the axis of rotation depending upon the particular application.

As a result of the pivoting motion, the axes of rotation of the idler roll assembly 200 and the drive roll 204 remain parallel. This prevents a side force from being exerted on a sheet which will cause sheet skew. Further, as a result of the idler rolls 202 being connected by shaft 203, the idler rolls 202 rotate at the same speed and prevent sheet skew as a result of a differential drive speed.

FIG. 4 illustrates the range of motion that is possible for the axis of rotation 250 of the idler assembly 200 as a result of the resilient central mounting. The axis of rotation is movable in both planes 252 and 254 simultaneously. The range of motion of the axis of rotation is essentially bounded by the conical areas shown as 260 and 262 in FIG. 4. Arrows 258 and 256 illustrate the motion directions of the axis of rotation, the combined resultant of which forms the conical sections 260, 262.

As the assembly 200 is retained by a single, centrally located resilient member 208, there is not a problem of uneven loading as can be caused when multiple spring mounts are used. The central mount causes the idler assembly 200 to pivot in whatever direction is necessary to align with the drive rolls 204. This pivot action also causes the nip normal force applied to the drive nip to equalize for each roll 202 as a result of the single spring mounting scheme.

The assembly as shown is adaptable to various locations throughout a printing machine. It may be used in a flat paper path, a curved paper path or it may be used in any one of a variety of document handling and finishing devices to provide a nip normal force without inducing sheet skew. Due to this versatility, the same idler design can be located in several locations thereby reducing the spare part inventory required for a particular machine or machines. The simplicity of the mounting device also allows for user replacement without the need for factory service calls.

In recapitulation, there is provided an idler system that provides even loading of a nip and is self-aligning with a drive roll. The idler assembly consists of a pair of rolls connected by a shaft, the shaft being supported in a housing. The housing provides a guide from the paper guide into the nip and from the nip to the post drive roll paper guide for increased capacity to handle curled and/or damaged cut sheet media. The housing is retained by a resilient spring member which member allows the axis of rotation of the idler rolls to pivot in more than one plane simultaneously. This pivoting causes the axis of rotation of the idler assembly to align parallel with the drive roll axis. The single spring also provides an even loading of the normal force across the width of the drive nip. As a result of the alignment and even loading, skewing of a sheet is prevented as it is driven through the nip formed by the drive roll and the idler roll. The resilient spring mounting also allows for easy replaceability of the idler assembly and the housing is easily locatable between tabs formed in the frame of the machine for mounting the idler assembly therein.

It is, therefore, apparent that there has been provided in accordance with the present invention, a self-aligning, self-centering idler assembly that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus for applying a normal force to a sheet being advanced by a drive member, comprising:

an idler member having a longitudinal axis of rotation, said idler member being in contact with the drive member to form a nip therebetween through which the sheet advances; and a retaining member to secure said idler member in contact with the drive member, said retaining member fastening said idler member so that said idler member may simultaneously pivot in a plurality of planes about a preselected point of the longitudinal axis of rotation to maintain alignment with the drive member.

2. An apparatus according to claim 1, wherein said retaining member comprises a resilient flexible member.

3. An apparatus according to claim 2, wherein said resilient flexible member comprises a spring.

4. An apparatus according to claim 1, wherein said idler member comprises:

a shaft;

a pair of rolls, each one of said rolls coaxially connected to opposite ends of said shaft; and a housing, located on said shaft, for rotatably supporting said shaft.

5. An apparatus for applying a normal force to a sheet being advanced by a drive member, comprising:

an idler member having a longitudinal axis of rotation, said idler member being in contact with the drive member to form a nip therebetween through which the sheet advances, said idler member comprising a shaft; a pair of rolls, each one of said rolls coaxially connected to opposite ends of said shaft; and a housing, located on said shaft, for rotatably supporting said shaft; and a retaining member to secure said idler member in contact with the drive member, said retaining member fastening said idler member so that said idler member may simultaneously pivot in a plurality of planes about a preselected point of the longitudinal axis of rotation to maintain alignment with the drive member, wherein said retaining member resiliently supports said housing to retain said idler member in contact with the drive member.

6. An apparatus for applying a normal force to a sheet being advanced by a drive member, comprising:

an idler member having a longitudinal axis of rotation, said idler member being in contact with the drive member to form a nip therebetween through which the sheet advances, said idler member comprising a shaft; a pair of rolls, each one of said rolls coaxially connected to opposite ends of said shaft; and a housing, located on said shaft, for rotatably supporting said shaft; and a retaining member to secure said idler member in contact with the drive member, said retaining member fastening said idler member so that said idler member may simultaneously pivot in a plurality of planes about a preselected point of the longitudinal axis of rotation to maintain alignment with the drive member, wherein said housing comprises a bearing member for rotatably supporting said shaft in said housing.

7. An electrophotographic printing machine having a paper path in which sheets are advanced by a drive member while having a normal force applied thereto, the normal force being applied by a self-aligning apparatus, comprising:

an idler member having a longitudinal axis of rotation, said idler member being in contact with the drive member to form a nip therebetween through which the sheet advances; and a retaining member to maintain said idler member in contact with the drive member, said retaining member fastening said idler member so that said idler member may simultaneously pivot in a plurality of planes about a preselected point of the longitudinal axis of rotation to maintain alignment with the drive member.

8. A printing machine according to claim 7, wherein said retaining member comprises a resilient flexible member.

9. A printing machine according to claim 8, wherein said resilient flexible member comprises a spring.

10. A printing machine according to claim 7, wherein said idler member comprises:

a shaft;

a pair of rolls, each one of said rolls coaxially connected to opposite ends of said shaft; and a housing, located on said shaft, for rotatably supporting said shaft.

11. An electrophotographic printing machine having a paper path in which sheets are advanced by a drive member while having a normal force applied thereto, the normal force being applied by a self-aligning apparatus, comprising:

an idler member having a longitudinal axis of rotation, said idler member being in contact with the drive member to form a nip therebetween through which the sheet advances, said idler member comprising a shaft; a pair of rolls, each one of said rolls coaxially connected to opposite ends of said shaft; and a housing, located on said shaft, for rotatably supporting said shaft; and a retaining member to maintain said idler member in contact with the drive member, said retaining member fastening said idler member so that said idler member may simultaneously pivot in a plurality of planes about a preselected point of the longitudinal axis of rotation to maintain alignment with the drive member, wherein said retaining member resiliently supports said housing to retain said idler member in contact with the drive member.

12. An electrophotographic printing machine having a paper path in which sheets are advanced by a drive member while having a normal force applied thereto, the normal force being applied by a self-aligning apparatus, comprising:

an idler member having a longitudinal axis of rotation, said idler member being in contact with the drive member to form a nip therebetween through which the sheet advances, said idler member comprising a shaft; a pair of rolls, each one of said rolls coaxially connected to opposite ends of said shaft; and a housing, located on said shaft, for rotatably supporting said shaft; and a retaining member to maintain said idler member in contact with the drive member, said retaining member fastening said idler member so that said idler member may simultaneously pivot in a plurality of planes about a preselected point of the longitudinal axis of rotation to maintain alignment with the drive member, wherein said housing comprises a bearing member for rotatably supporting said shaft in said housing.

* * * * *